US005539931A

United States Patent [19]

Fizer et al.

[11] Patent Number: 5,539,931

[45] Date of Patent: Jul. 30, 1996

[54] BARE SHOULDER PROTECTOR

[76] Inventors: Birdie L. Fizer, 8220 S. Jeffery, Chicago, Ill. 60617; Diana Lipscomb, 7313 S. East End, Chicago, Ill. 60649

[21] Appl. No.: 273,394

[22] Filed: Jul. 11, 1994

[51] Int. Cl.[6] ..... A41D 27/26; A41C 03/12

[52] U.S. Cl. ..... 2/268; 2/267; 450/86

[58] Field of Search ..... 2/2–2.5, 46, 105, 2/106, 267, 268, 912, 104, 113, 114, 115; 450/86

[56] References Cited

U.S. PATENT DOCUMENTS

| | | | |
|---|---|---|---|
| 2,505,272 | 4/1950 | Blalock et al. . | |
| 2,534,513 | 12/1950 | Gerry | 2/268 |
| 3,025,859 | 3/1962 | Rosenberg . | |
| 3,046,991 | 7/1962 | Heberling . | |
| 3,050,734 | 8/1962 | Dopyera | 2/2 |
| 3,229,694 | 1/1966 | Koropp . | |
| 4,100,924 | 7/1978 | Rosenberg . | |
| 4,125,904 | 11/1978 | Levine . | |
| 4,472,838 | 9/1984 | Pompa . | |
| 4,575,874 | 3/1986 | Johnson | 2/2 |
| 4,612,935 | 9/1986 | Greifer | 2/268 |
| 4,795,399 | 1/1989 | Davis . | |
| 4,795,400 | 1/1989 | Greenberg . | |
| 4,945,576 | 8/1990 | Melton . | |
| 5,155,869 | 10/1992 | Ralli et al. | 450/86 |
| 5,165,113 | 11/1992 | Hyams et al. . | |
| 5,201,078 | 4/1993 | Melton . | |
| 5,240,538 | 8/1993 | Hyams et al. . | |
| 5,308,278 | 5/1994 | Huang | 450/86 |

*Primary Examiner*—Jeanette E. Chapman
*Attorney, Agent, or Firm*—Trexler, Bushnell, Giangiorgi & Blackstone, Ltd.

[57] ABSTRACT

A first embodiment of a novel shoulder protector for a brassiere shoulder strap includes first, second and third layers of material. The first layer is a soft cushion material and contacts the skin of a wearer. The second layer is made of a material having a high degree of rigidity that may be heated to conform to the shoulder of a wearer and provides a bearing surface for the strap. The third layer is releasably attached to the second layer and overlays the second layer. The brassiere strap is sandwiched between the second and third layers are securely held therebetween. The second embodiment of the shoulder protector eliminates the third layer and instead a tongue is provided in the second layer under which the brassiere strap is securely held.

15 Claims, 3 Drawing Sheets

BARE SHOULDER PROTECTOR

BACKGROUND OF THE INVENTION

This invention is generally directed to a novel shoulder protector which protects a wearer's shoulder from bruising and discoloration which is caused by a brassiere strap. More particularly, the invention contemplates a shoulder protector that securely holds the brassiere strap securely and minimizes the amount of movement of the strap on the wearer's shoulder.

The shoulder straps of a brassiere tend to cause irritation and bruises due to the straps digging, rubbing or indenting into the skin of the shoulders. This is especially a problem for full-figured women.

Prior art pads have attempted to provide relief for women from the irritation that occurs due to the straps. One such attempt is disclosed in U.S. Pat. No. 4,612,935 which uses a cushion pad which is attached to the underside of the strap. While this type of prior art pad provides some relief, the pad is often not stiff enough to prevent the brassiere strap from indenting into the pad and into the shoulder of the wearer.

U.S. Pat. No. 4,795,399 provides a pad that includes a stiff material which has a cushion material attached thereto. The cushion material contacts the skin of the wearer. The strap is connected to the pad by tabs which are formed in the rigid material. While this type of pad distributes the weight of the strap and effectively prevents the strap from indenting into the shoulder of a wearer, it appears that the tabs often do not securely hold the strap in place. The tabs may catch on the inside of the clothing that covers the brassiere strap which may cause the strap to become dislodged from the pad. Additionally, the tabs may cause unsightly bulging in the clothing.

The present invention provides a novel shoulder protector pad which effectively prevents the strap from digging, rubbing or indenting into the shoulder of a wearer while minimizing the visibility of the shoulder protector under clothing. The present invention also provides an improved attachment for the brassiere strap to the protector so that the possibility of the strap dislodging from the protector is minimized.

OBJECTS AND SUMMARY OF THE INVENTION

A general object of the present invention is to provide a novel shoulder protector that prevents bruising and discoloration of a wearer's shoulder by a brassiere strap.

An object of the present invention is to provide a shoulder protector that effectively distributes the weight of a brassiere strap.

Another object of the present invention is to provide a shoulder protector which minimizes the amount of indentation into the shoulder of a wearer by a brassiere strap.

Yet another object of the present invention is to provide a shoulder protector that is relatively small, thin and short.

An object of the present invention is to provide a shoulder protector that provides a means for easily attaching and detaching a brassiere strap to the protector.

Another object of the present invention is to provide a shoulder protector which supports the bust and improves a wearer's posture.

A further object of the present invention to provide a shoulder protector that effectively minimizes the possibility of a brassiere strap becoming dislodged from the protector.

A specific object of the present invention is to provide a shoulder protector which can be shaped to conform to a shoulder of a wearer.

Briefly, and in accordance with the foregoing, the present invention discloses a shoulder protector for a brassiere shoulder strap. The first embodiment of the shoulder protector includes first, second and third layers of material. The first layer is a soft cushion-like material and contacts the skin of a wearer. The second layer is a lightweight material having a high degree of rigidity that may be heated to conform to the shoulder of a wearer and provides a bearing surface for the strap. The third layer is releasably attached to the second layer and overlays the second layer. The brassiere strap is sandwiched between the second and third layers and securely held therebetween.

The second embodiment of the shoulder protector of the present invention is similar to the first embodiment but the third layer of material is eliminated in this embodiment. As such, the second embodiment includes only a first and second layer of material. The first layer and second layers of the second embodiment are formed from like materials to that of the first embodiment. The second layer provides a bearing surface for the strap and includes a tongue under which the strap is seated to securely attach the strap to the protector.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
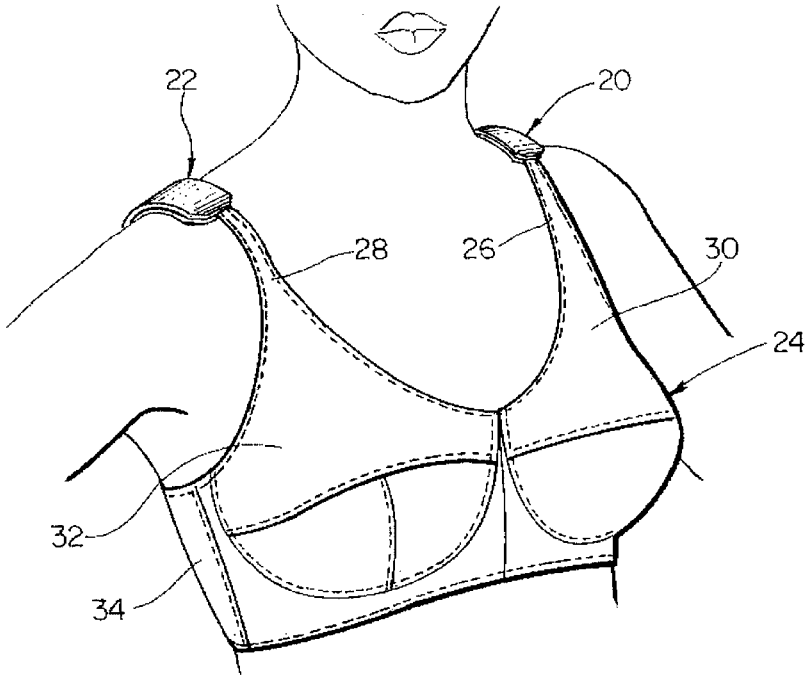
FIG. 1 is a front perspective view of a person wearing a brassiere having shoulder protectors which incorporate features of a first embodiment of the invention on each shoulder strap of the brassiere.
Figure 2:
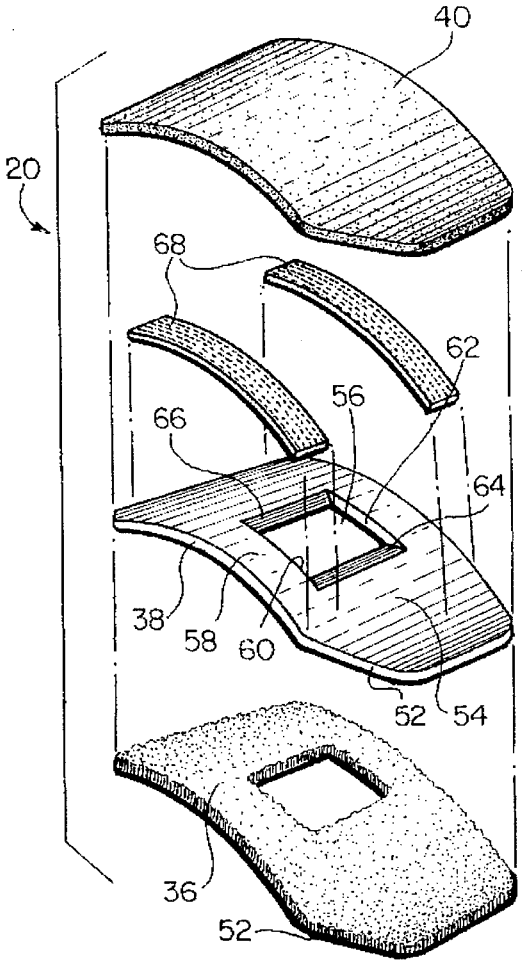
FIG. 2 is an enlarged, exploded perspective view of one of the protectors shown in FIG. 1.
Figure 3:
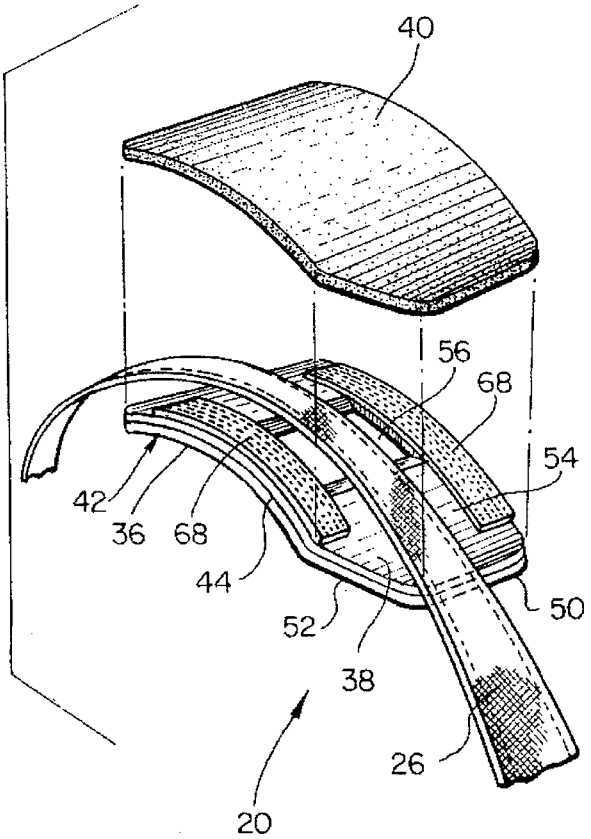
FIG. 3 is an enlarged, partially exploded perspective view of the protector shown in FIG. 2 with a brassiere strap attached thereto.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Referring now to the drawings, as shown in FIG. 1, a first embodiment of novel shoulder protectors 20, 22 which incorporate features in accordance with the present invention is used with a brassiere 24 of known construction. Briefly, the brassiere 24 includes shoulder straps 26, 28, each having a first end 30 which extends from an upper portion of a halter portion 32 and a second end (not shown) which extends from an encircling band 34.

When the brassiere 24 is worn without shoulder protectors 20, 22, the straps 26, 28, when taut, often dig into the skin on the shoulders of the wearer forming indentations. These indentations tend to irritate the skin and often cause bruises on the shoulders of the wearer. The present invention provides protectors 20, 22 which are placed between the brassiere strap 26, 28, respectively, and shoulder of the wearer and effectively minimizes the irritation and bruises caused by the straps.

Figure 8:
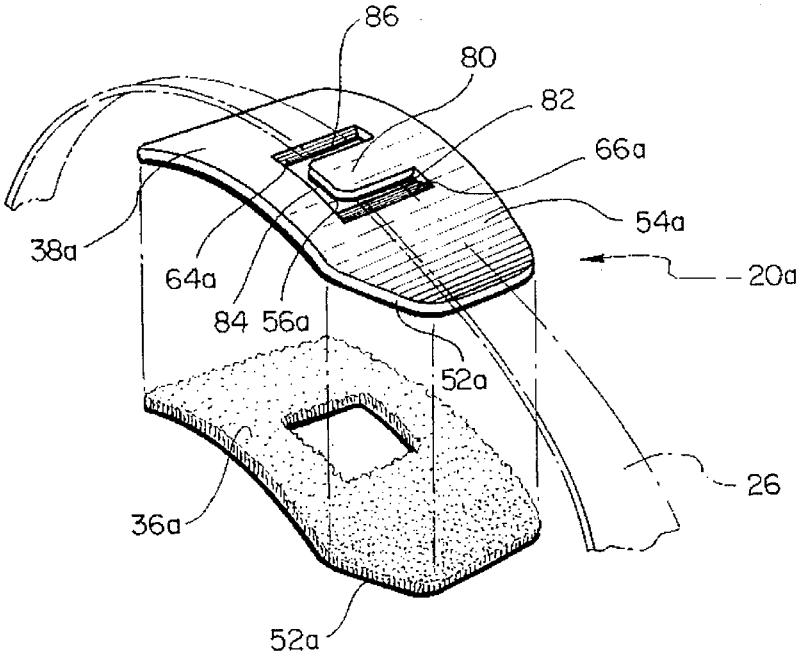
FIG. 8 is an enlarged, exploded perspective view of a second embodiment of a novel shoulder protector.
Figure 10:
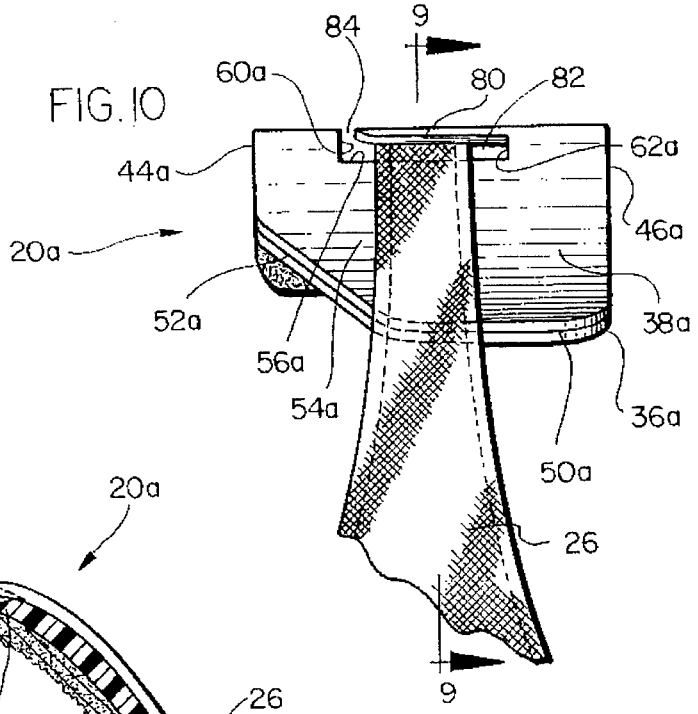
FIG. 10 is a cross-sectional view of the protector shown along line 9—9 of FIG. 9 shown in a fully assembled configuration with the brassiere strap attached thereto.
Figure 9:
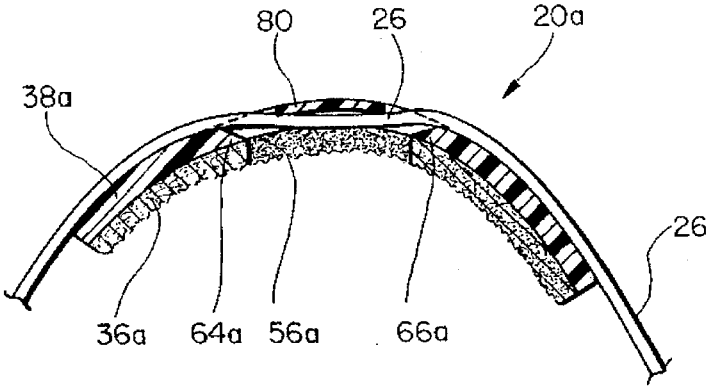
FIG. 9 is a partial front elevational view of the protector of FIG. 8 with the brassiere strap attached thereto.

A first embodiment of the shoulder protector 20, as shown in FIGS. 1–5 is described first. Thereafter, a second embodiment of the shoulder protector 20*a*, as shown in FIGS. 8–10, is described. Like elements of the second embodiment are denoted by like reference numerals but include the suffix "a" after the numeral.

With respect to the first embodiment, the shoulder protector 20 is described herein. It is to be understood that the shoulder protector 22 is identical except for the differences described herein.

The first embodiment of the shoulder protector 20 has a bottom or first layer 36, an intermediate or second layer 38 and a top or third layer 40. The first layer 36 and the second layer 38 combine to form a pad portion 42 of the shoulder protector 20. The protector 20 is shaped so that it does not have any sharp edges which could cut into, rub or otherwise irritate the skin of the wearer. Preferably, the shoulder protector 20 is an elongate member having straight lateral edges 44, 46, a curved rear edge 48 and a generally curved front edge 50. The generally curved front edge 50 includes a slanted edge portion 52 which interrupts the shape of the curve for reasons described herein.

The bottom or first layer 36 of material includes an upper surface and a lower surface. The first layer 36 is formed from a cushion-like material, preferably moleskin. The lower surface of the first layer 36 contacts the skin of the wearer when the protector 20 is attached to the brassiere strap 26. The moleskin may have a self adhesive backing to secure the top surface of the first layer 36 to the bottom surface of the second layer 38 once the second layer 38 has been shaped as described herein.

The intermediate or second layer 38 of material includes an upper surface and a lower surface. The second layer 38 is formed from a suitable material. The lower surface of the second layer 38 is secured to the upper surface of the first layer 36 by suitable means, such as by gluing or by adhesive.

The second layer 38 of material is preferably formed from a lightweight, low temperature thermoplastic material, such as Polyform, which offers comfort with a high degree of rigidity, so that the shoulder protector 20 can be custom fit to a wearer's shoulder. To custom fit the shoulder protector 20, the second layer 38 is heated, for example by immersing the second layer 38 of lightweight, low temperature thermoplastic material into hot water, and is then molded to the shape of the wearer's shoulder. Depending on the preference of the wearer, the shoulder protector 20 can be fitted tightly or loosely to the wearer's shoulder.

The upper surface of the second layer 38 provides a bearing surface 54 upon which the brassiere shoulder strap 26 sits when the protector 20 is attached to the strap 26. Since the second layer 38 is made of a material having a high degree of rigidity, such as plastic, a wide, rigid bearing surface 54 is provided to distribute pressure of strap 26 across the protector 20.

Also, since the second layer 38 is made of a material having a high degree of rigidity material, the indentation of the strap 26 into the shoulder protector 20 is effectively minimized and thus the strap 26 is effectively prevented from substantially indenting into the shoulder of the wearer. This minimizes the amount of bruising and discoloration which can occur from the brassiere strap 26 rubbing into the shoulder of the wearer.

Figure 4:
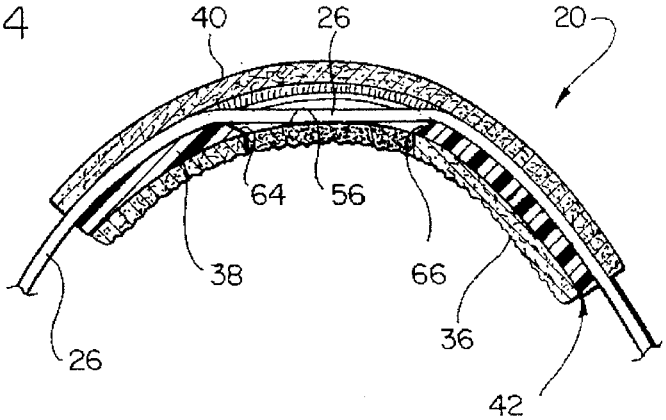
FIG. 4 is a cross-sectional view of the protector of FIGS. 2 and 3 shown in a fully assembled configuration with the brassiere strap attached thereto.
Figure 5:
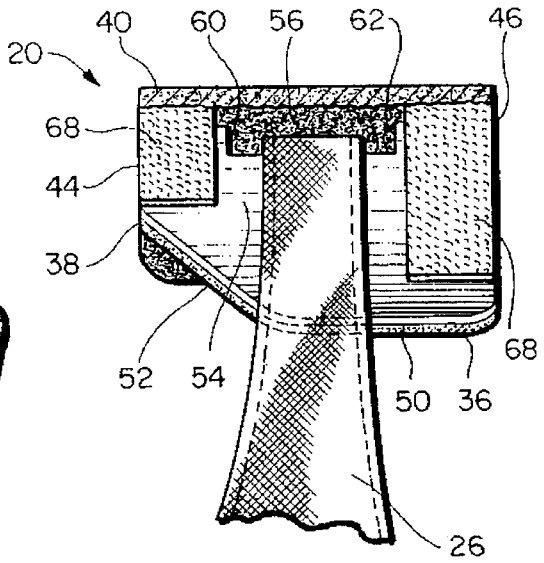
FIG. 5 is a partial front elevational view of the protector of FIGS. 2 and 3 with the brassiere strap attached thereto.

The novel bearing surface 54 of the shoulder protector 20 is provided with a channel or recess 56 along a middle portion 58 of the protector 20 which generally corresponds to the topmost point of curvature of the wearer's shoulder. The recess 56 has straight lateral edges 60, 62 and tapered front and rear edges 64, 66. Since the front and rear edges 64, 66 are tapered, the brassiere strap 26 lies flush with the upper surface of the second layer 38 along the uppermost point of curvature of the wearer's shoulder when the brassiere strap 26 is seated within the recess 56 as shown in FIG. 4. Thus, the brassiere strap 26 is seated and confined within the recess 56. Movement of the strap 26 in a side-to-side fashion is confined to the width of the recess 56. The shoulder protector 20 can be moved along the length of the brassiere strap 26 to allow a wearer to correctly position the protector 20 along the shoulder arch.

The recess 56 may formed as an aperture which extends through the first and second layers 36, 38 as illustrated in the drawings. Alternatively, the recess 56 may be formed such that the recess 56 does not extend completely through the second layer 38 or as an aperture which extends only through the second layer 38 such that the first layer 36 is not interrupted.

The top or third layer 40 of material is formed from a suitable, flexible material having a lower surface and a smooth upper surface. The second and third layers 38, 40 are releasably secured to each other by suitable means. As shown in the drawings, and which is the preferred embodiment, a strip 68 of VELCRO® material is secured to the upper surface of the second layer 38 adjacent each of its lateral edges 44, 46 by suitable means, such as adhesive. The lower surface of the third layer 40 is formed of a complementary VELCRO® material which releasably attaches to the strips 68 of VELCRO® material. As is well known, VELCRO® material is made of hook and pile material.

The third layer 40 of material overlays the second layer 38 and sandwiches or traps the brassiere strap 26 between the second and third layers 38, 40. Preferably, the third layer 40 completely overlays the second layer 38. By covering the entire second layer 38, the clothing or garments which overlay the shoulder protector 20 will glide smoothly over the smooth upper surface of the third layer 40. The smooth upper surface of the third layer 40 effectively prevents the brassiere shoulder strap 26 from catching on the inside of the clothing or garments which can cause the strap 26 to become dislodged from the protector 20, or can cause the protector 20 to move around on the shoulder.

The curved front edge 50 of the protector 20 includes the slanted edge portion 52 which interrupts the shape of the front edge 50. Preferably, the slant is a thirty degree angle relative to the lateral edge 44. For a protector 20 that is worn on a left shoulder of a wearer, the front, right side of the protector 20 includes the slanted edge portion 52. For a protector 22 that is worn on the right shoulder, the front, left side of the protector 22 includes the slanted edge portion 52. The slanted edge portion 52 minimizes the possibility of the protector 20, 22 rubbing into the cervical bone.

The brassiere strap 26 is easily attached to the novel shoulder protector 20 of the present invention and is easily removed from the protector 20. To put on the shoulder protector 20, the wearer places the pad portion 42 of the protector 20 under the shoulder strap 26 and positions the strap 26 so that the strap 26 is seated within the recess 56. The shoulder protector 20 can be slid along the length of the shoulder strap 26 to correctly and comfortably position the protector 20 over the arch of the shoulder. Thereafter, the top or third layer 40 of material is attached to the second layer 38.

When the shoulder protector 20 is attached to the brassiere strap 26, the protector 20 covers the shoulder arch and prevents the strap 26 from contacting the skin of the shoulder arch. This prevents the strap 26 from rubbing or biting into the shoulder of the wearer and minimizes the irritation which can be caused by the brassiere strap 26.

To remove the shoulder protector 20, the top layer 40 is peeled off or released from the second layer 38. The pad portion 42 is then removed from under the shoulder strap 26.

The shoulder protector 20 of the present invention provides several advantages. It helps to give extra support to the bust. The shoulder protector 20 provides better lifting support and more even distribution of the weight of the bust which permits improved posture with resulting benefits, such as straightening, to the spine. Furthermore, the novel shoulder protector 20 of the present invention is durable and reusable. Also, the protector 20 is washable, with air-drying to maintain its shape.

The shoulder protector 20 is designed to be relatively small, thin and short, thereby resulting in minimal bulging in garments which are placed thereover. For example, the shoulder protector 20 of the present invention may have a width of two to three inches, a length of three and a half to six inches and a thickness of three and a quarter to five centimeters.

Figure 7:
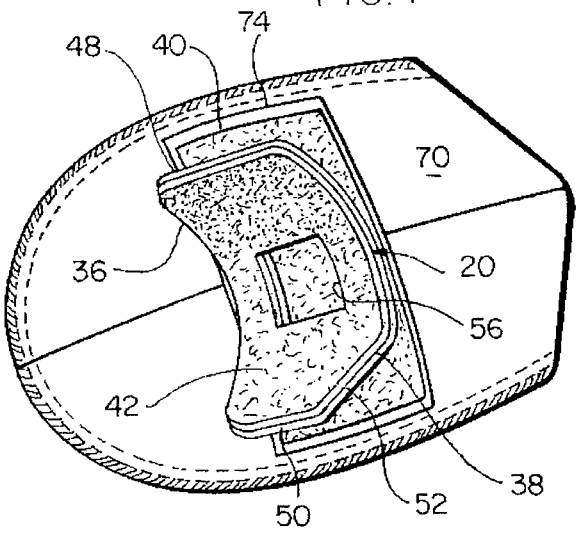
FIG. 7 is a perspective view of the shoulder pad of FIG. 6 with the novel shoulder protector of the present invention attached thereto.

As shown in FIG. 7, the shoulder protector 20 of the present invention can be used with a conventional shoulder pad 70. Often, shoulder pads which are provided with clothing are poorly made and lose their shape. A wearer may replace the poorly made pad with a better quality shoulder pad. Shoulder pads 70 are of known construction and are made of a cushion material and has an upper or top surface and a lower or bottom surface. The upper surface contacts the clothing of the wearer.

Figure 6:
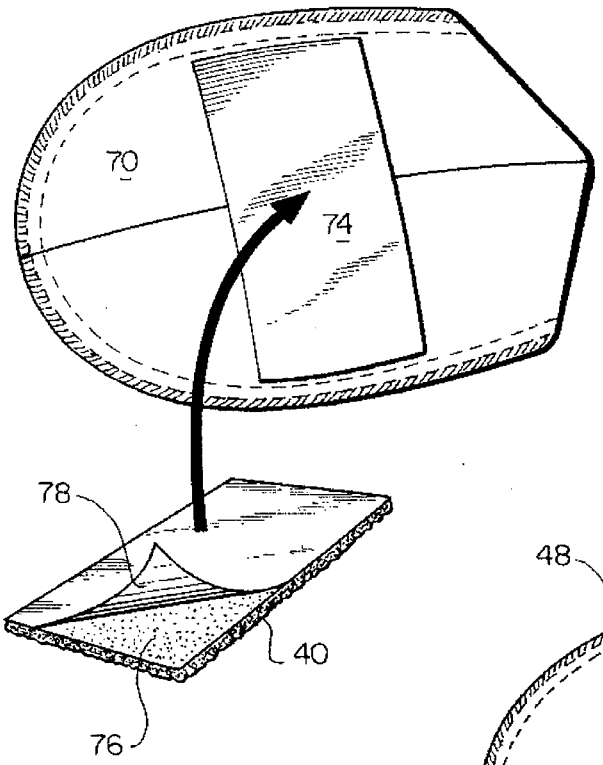
FIG. 6 is a perspective view of a shoulder pad which is used in combination with a novel shoulder protector of the present invention with the top layer of the shoulder protector.

When used with the novel shoulder protector 20 of the present invention, a suitable means for attaching the protector 20 to the shoulder pad 70 together is provided. An example of a suitable means for attaching is shown in FIG. 6, which includes a release liner 74 which is secured to the lower surface of the shoulder pad 70 by suitable means, such as adhesive, and the upper surface of the top or third layer 40 of the shoulder protector 20 is coated with an adhesive 76 covered by a release liner 78. To secure the protector 20 to the shoulder pad 70, the adhesive 76 on the third layer 40 is adhered to the release liner 74 on the shoulder pad 70. The protector 20 can be removed from the shoulder pad 70 and used with other garments or shoulder pads.

It is to be understood that other suitable means for securing the third layer 40 of the protector 20 to the shoulder pad 70 are within the scope of the invention. For example, the third layer 40 may be sewn to the underside of the shoulder pad 70 and the pad portion 42 of the protector 20 connected to the sewn third layer. If this securing means is used, a wearer simply obtains another third layer if the protector 20 is desired to be worn without a shoulder pad.

The second embodiment of the shoulder protector **20*a*, as shown in FIGS. 8–10, is similar to the first embodiment of the shoulder protector 20, 22, except for the differences noted hereinbelow and is used with a brassiere 24 of the type described herein. It is to be understood that all of the above features and advantages as described with respect to the first embodiment of the shoulder protector 20, 22 are found in the second embodiment of the shoulder protector 20*a*** except for the differences described herein.

The shoulder protector **20*a* includes only the bottom or first layer 36*a* made of a soft, cushion-like material like that of the first embodiment, and the second layer 38*a* made of a lightweight, low temperature thermoplastic material possessing a high degree of rigidity like that of the first embodiment. Thus, the third layer of material 38 has been eliminated in this embodiment. The elimination of the third layer 38 reduces the thickness of the shoulder protector 20*a*** and provides for a minimal amount of bulging in garments, for example in a sleeveless blouse, which are placed thereover.

The second layer **38*a* is provided with a channel or recess 56*a*, similar to that of the first embodiment with the exception that a tab or tongue 80 is formed in the second layer 38*a* that projects over a portion of the recess 56*a*. The tongue 80 lies flush with the upper surface of the second layer 38*a*. The brassiere strap 26 is seated underneath the tongue 80 to securely hold the strap 26 to the protector 20*a* and since the recess 56*a* has the tapered front and rear edges 64*a*, 66*a*, the brassiere strap 26 is seated and confined within the recess 56*a*. Movement of the strap 26 in a side-to-side fashion is confined to the width of the recess 56*a***.

Spaces 82, 84 and 86, of a predetermined width, are provided around three sides of the tongue 80 so as to allow the strap 26 to be attached to the protector **20*a* as described herein. The space 84 is of a width that is less than the width of the brassiere strap 26 so as to minimize the possibility of the strap being released from under the tongue 80 when the strap 26 is attached to the protector 20*a***.

The tongue 80 has rounded edges to prevent the tongue 80 from catching on the brassiere strap 26 as the strap 26 is placed under the tongue 80 and into the recess **56*a*. For a shoulder protector 20*a* that is worn on the left shoulder, that is a protector 20*a* that has the slanted edge portion 52*a* on the front, right side of the protector 20, the tongue 80 extends towards the slanted edge portion 52*a* and inwardly towards the neck of the wearer. For a protector that is worn on the right shoulder, that is a protector that has the slanted edge portion on the front, left side of the protector 22, the tongue extends towards the slanted edge portion and inwardly towards the neck of the wearer. This allows gravity to aid in keeping the strap 26 or 28 securely held in the protector 20*a* and to minimize the possibility of the strap 26 or 28 from slipping out of the recess 56*a***.

To insert the strap 26 into the protector **20*a*, the wearer simply inserts the strap into the space 84 and slides the strap 26 under the tongue 80 until the strap 26 is seated within the recess 56*a*. To remove the strap 26 from the protector 20*a*, the strap 26 is simply slid out from under the tongue 80 and released from the recess 56*a***.

While preferred embodiments of the present invention are shown and described, it is envisioned that those skilled in the art may devise various modifications of the present invention without departing from the spirit and scope of the invention as set forth in the appended claims. The invention is not intended to be limited by the foregoing disclosure.

The invention claimed is:

1. A shoulder protector for a brassiere shoulder strap comprising:

a first layer comprising a soft cushion material having an upper surface and a lower surface, said lower surface being adapted for contacting the skin of a wearer;

a second layer comprising a generally rigid material having an upper surface and a lower surface, said upper surface of said second layer providing a bearing surface for a brassiere strap, said lower surface of said second layer and said upper surface of said first layer being secured together;

a recess formed in said second layer of material, said recess commencing at said upper surface of said second layer and extending below said upper surface of said second layer a predetermined distance and extending along a portion of said second layer of material said brassiere strap being seated in said recess, said recess confining said brassiere strap within said recess; and a third layer of material having an upper surface and a lower surface, and means for releasably attaching said lower surface of said third layer to said upper surface of said second layer when said brassiere strap is sandwiched between said second and third layers, said releasable attaching means being connected to said upper surface of said second layer.

2. A shoulder protector as defined in claim 1, wherein said first and second layers include front, rear and side edges, and said recess includes a front edge; a rear edge and side edges, said front and rear edges of said recess commencing at the upper surface of said second layer and tapering downwardly therefrom, said brassiere strap overlaying said tapered front and rear edges of said recess when said brassiere strap is seated within said recess.

3. A shoulder protector as defined in claim 1, wherein said bottom surface of said third layer and said releasable attaching means are comprised of complementary hook and pile material.

4. A shoulder protector as defined in claim 1, wherein said third layer of material substantially covers said second layer of material.

5. A shoulder protector as defined in claim 1, wherein said first and second layers of material include generally straight lateral edges, a generally curved rear edge and a generally curved front edge, said front edge including a slanted edge portion.

6. A shoulder protector as defined in claim 1, wherein said first layer of material is comprised of moleskin.

7. A shoulder protector as defined in claim 1, wherein said second layer is comprised of thermoplastic material which can be heated and shaped to conform to a shoulder of a wearer.

8. A shoulder protector for a brassiere shoulder strap comprising:

a first layer comprising a soft cushion material having an upper surface and a lower surface, said lower surface being adapted for contacting the skin of a wearer; and a second layer comprising a generally rigid material having an upper surface and a lower surface, said lower surface of said second layer and said upper surface of said first layer being secured together, said upper surface of said second layer providing a bearing surface for a brassiere strap for maintaining said brassiere strap and said upper surface of said second layer in contact;

a recess formed in said second layer of material, said recess commencing at said upper surface of said second layer and extending below said upper surface of said second layer a predetermined distance and extending along a portion of said second layer of material, said brassiere strap being seated in said recess, said recess causing said brassiere strap to maintain engagement with said shoulder protector and confining said brassiere strap within said recess; and a tongue portion formed with said second layer of material, said tongue portion extending over a portion of said recess for confining said brassiere strap under said tongue portion and within said recess, said tongue portion having an upper surface which is flush with the second layer of material when said brassiere strap is confined within said recess and under said tongue portion.

9. A shoulder protector as defined in claim 8, wherein said first and second layers include generally straight lateral edges, a generally curved rear edge and a generally curved front edge, said front edge including a slanted edge portion.

10. A shoulder protector as defined in claim 8, wherein said first layer of material is comprised of moleskin.

11. A shoulder protector as defined in claim 8, wherein said second layer is comprised of thermoplastic material which can be heated and shaped to conform to a shoulder of a wearer.

12. A shoulder protector as defined in claim 8, wherein said tongue portion has rounded edges.

13. A shoulder protector as defined in claim 8, wherein said first and second layers include front, rear and side edges, and said recess includes a front edge, a rear edge and side edges, said front and rear edges of said recess commencing at the upper surface of said second layer and tapering downwardly therefrom, said brassiere strap overlaying said tapered front and rear edges of said recess when said brassiere strap is seated within said recess.

14. A combination of a shoulder protector for a brassiere shoulder strap and a shoulder pad, said shoulder protector comprising:

a first layer comprising a soft cushion material having an upper surface and a lower surface, said lower surface being adapted for contacting the skin of a wearer, a second layer comprising a generally rigid material having an upper surface and a lower surface, said upper surface of said second layer providing a bearing surface for a brassiere strap, said lower surface of said second layer and said upper surface of said first layer being secured together, and a third layer of material having an upper surface and a lower surface, and means for releasably attaching said lower surface of said third layer to said upper surface of said second layer when said brassiere strap is sandwiched between said second and third layers, said releasable attaching means being connected to said upper surface of said second layer; and said shoulder pad comprising: a soft cushion material having an upper surface and a lower surface and means for releasably securing said upper surface of said third layer of material to said lower surface of said shoulder pad.

15. The combination of claim 14, wherein said means for releasably securing said upper surface of said third layer of material to said lower surface of said shoulder pad comprises adhesive secured to said upper surface of said third layer and a release liner secured to the lower surface of the pad.

* * * * *